US011395374B2

(12) United States Patent
Qi

(10) Patent No.: US 11,395,374 B2
(45) Date of Patent: Jul. 19, 2022

(54) INFRARED HEATING MECHANISM AND DEVICE

(71) Applicant: Ningbo Youming Electrical Appliance Co., Ltd., Zhejiang (CN)

(72) Inventor: Wenguo Qi, Ningbo (CN)

(73) Assignee: NINGBO YOUMING ELECTRICAL APPLIANCE CO., LTD., Zhejiang (CN)

( * ) Notice: Subject to any disclaimer, the term of this patent is extended or adjusted under 35 U.S.C. 154(b) by 760 days.

(21) Appl. No.: 16/216,662

(22) Filed: Dec. 11, 2018

(65) Prior Publication Data

US 2020/0015322 A1 Jan. 9, 2020

(30) Foreign Application Priority Data

Jul. 6, 2018 (CN) ..... 201821076754.5
Aug. 14, 2018 (CN) ..... 201821303854.7

(51) Int. Cl.

| | |
|---|---|
| ***H05B 3/00*** | (2006.01) |
| ***H05B 3/42*** | (2006.01) |
| ***H05B 3/16*** | (2006.01) |
| ***H05B 31/00*** | (2006.01) |
| *F21V 7/00* | (2006.01) |
| *F21V 7/10* | (2006.01) |

(52) U.S. Cl.

CPC ..... *H05B 3/009* (2013.01); *H05B 3/16* (2013.01); *H05B 3/42* (2013.01); *H05B 31/0072* (2013.01); *F21V 7/005* (2013.01); *F21V 7/10* (2013.01); *H05B 2203/032* (2013.01)

(58) Field of Classification Search

None

See application file for complete search history.

(56) References Cited

U.S. PATENT DOCUMENTS 1,358,059 A * 11/1920 Clutts ..... F24H 3/0417 392/365
2,019,967 A * 11/1935 Hoesel ..... F28F 1/32 165/134.1
2,181,230 A * 11/1939 Groat ..... F28F 3/083 165/70

(Continued)

FOREIGN PATENT DOCUMENTS

JP 2004526114 A 8/2004
JP 3917577 B2 5/2007

(Continued)

OTHER PUBLICATIONS

Office action dated Oct. 28, 2019 in related Korean application No. 20-2019-0000043.

(Continued)

*Primary Examiner* — Thor S Campbell

(74) *Attorney, Agent, or Firm* — Polson Intellectual Property Law, PC; Margaret Polson

(57) ABSTRACT

An infrared heating mechanism and device are provided. The infrared heating mechanism includes infrared heating tubes, wherein a plurality of reflection plates are disposed at intervals in a length direction of the infrared heating tubes, and mounting holes corresponding to the infrared heating tubes are provided on the reflection plates so that the reflection plates are sleeved on side walls of the infrared heating tubes.

15 Claims, 6 Drawing Sheets

(56) References Cited

U.S. PATENT DOCUMENTS 2,226,291 A * 12/1940 Wall ..... F28F 1/32 165/180
2,274,348 A * 2/1942 Sharp ..... H05B 3/76 219/453.14
RE22,177 E * 9/1942 Sharp ..... H05B 3/76 219/453.14
2,354,865 A * 8/1944 Kucher ..... F28D 1/0333 165/148
2,400,157 A * 5/1946 Merry ..... F02F 1/08 165/180
2,405,722 A * 8/1946 Villier ..... F28F 1/14 165/122
2,565,443 A * 8/1951 Vogel ..... H05B 3/76 219/454.12
2,596,008 A * 5/1952 Collins ..... F28D 9/0037 165/167
2,599,965 A * 6/1952 Young ..... F28F 9/013 165/134.1
2,662,158 A * 12/1953 Vallorani ..... H05B 3/688 219/453.14
2,957,157 A * 10/1960 Carter ..... H01R 33/02 439/226
2,959,400 A * 11/1960 Simpelaar ..... F28D 9/0037 165/166
3,031,171 A * 4/1962 Buttner ..... H05B 3/50 165/182
3,056,012 A * 9/1962 Hanson ..... F24C 15/102 219/453.14
3,176,117 A * 3/1965 Knoll ..... F24H 3/0411 392/360
3,211,219 A * 10/1965 Rosenblad ..... F28D 9/0087 165/166
3,343,596 A * 9/1967 Kritzer ..... F25D 21/08 165/67
3,396,458 A * 8/1968 Meng ..... B21C 37/202 29/615
3,397,741 A * 8/1968 Gunter ..... F28F 1/325 165/151
3,493,040 A * 2/1970 Davidson ..... C02F 1/08 165/115
3,632,987 A * 1/1972 Orr ..... F24H 3/002 219/530
4,352,008 A * 9/1982 Hofer ..... H05B 3/50 165/183
4,487,256 A * 12/1984 Lutjens ..... F28F 1/20 165/183
4,558,736 A * 12/1985 Ziemek ..... B21D 53/08 165/183
4,900,898 A * 2/1990 Kling ..... F24H 3/0405 392/503
5,278,354 A * 1/1994 Lhomme ..... H01R 4/72 174/84 C
5,406,031 A * 4/1995 Mathieu ..... H01R 4/723 174/84 R
5,765,384 A * 6/1998 Carlstedt ..... F25D 21/08 62/276
8,642,926 B2 * 2/2014 Kochems ..... F24H 3/0429 219/202
9,234,677 B2 * 1/2016 Clade ..... F24H 3/0441
2004/0112884 A1 * 6/2004 Uhl ..... F24H 3/0441 219/202
2012/0328270 A1 * 12/2012 Dykman ..... F24H 9/2071 392/360

FOREIGN PATENT DOCUMENTS

KR 20010093891 A 10/2001
KR 20130024642 A 3/2013

OTHER PUBLICATIONS

Written Opinion dated May 26, 2020 in related Korean application No. 20-2019-0000043.
Office action dated Feb. 18, 2019 in related Japanese application No. 2019-000285.

* cited by examiner

INFRARED HEATING MECHANISM AND DEVICE

CROSS-REFERENCE TO RELATED APPLICATIONS

The present disclosure claims priority to the Chinese patent application No. 2018210767545, which is filed with the Chinese Patent Office on Jul. 6, 2018 and entitled "Infrared Heating Mechanism and Device", and priority to the Chinese patent application No. 2018213038547, filed with the Chinese Patent Office on Aug. 14, 2018 and entitled "Infrared Heating Mechanism and Device", which are incorporated herein by reference in their entirety.

TECHNICAL FIELD

The present disclosure relates to the technical field of infrared heating devices, and particularly to an infrared heating mechanism and device.

BACKGROUND ART

Electric warmers are a kind of household appliance for warming in winter which converts electric energy into heat energy and has the characteristics such as convenient use, no pollution and no noise. At present, various types of electric warmers on the market are unique in shape and convenient to use, and have become fashionable electric appliances for household consumption. At present, the warmers on the market are mainly classified into liquid-filled warmers, fan warmers, radiant warmers, etc.

With regard to the radiant electric warmers, the heat energy emission thereof is characterized by emitting heat to the ambient in a radiating manner. The radiant electric warmer warms the human body in such a way, i.e., after being energized by electricity, quartz electric tubes radiate heat within the distance radiated by far infrared rays and radiate far infrared rays to the outside, and the far infrared rays are absorbed by the human body and converted into heat energy. The radiant electric warmers look compact, are easy to be moved and are suitable for heating in a small space, and generally have an electrical power within the range of 800 w-3000 w.

The existing infrared heaters are all composed of an infrared heating tube and a reflection cover, wherein the reflection cover is disposed on one side of the heating tube and the reflection cover is capable of reflecting the infrared light emitted from the heating tube towards the direction opposite to the reflection cover. The infrared heating tube radiates infrared rays towards the reflection cover, and energy accumulates on the side of the reflection cover. As a result, the temperature on this side is remarkably higher than the temperature on the side of the infrared heating tube, resulting in excessively high temperature in the vicinity of the infrared heating tube. This will lead to aging and damages to the connector and lead wire of the infrared heating tube. Moreover, due to accumulation of heat, the infrared heating tube will have a very high temperature. In the heating process, heat is spread in a single direction, which is unfavorable for temperature rise of the whole room and also brings forth burning sensation, causing discomfort to the human body.

SUMMARY

An infrared heating mechanism provided in an embodiment of the present disclosure comprises infrared heating tubes, a plurality of reflection plates being disposed at intervals in a length direction of the infrared heating tubes, and the plurality of reflection plates are each provided with mounting holes corresponding to the infrared heating tubes, so that the reflection plates are sleeved on side walls of the infrared heating tubes.

An infrared heating mechanism provided in an embodiment of the present disclosure comprises a socket assembly and an electric heating tube independent of each other, wherein an electric connector is provided on the electric heating tube, a first electrically conductive structure and a second electrically conductive structure are provided on the socket assembly and the electric connector, respectively, so that after the electric connector is inserted into the socket assembly, the first electrically conductive structure and the second electrically conductive structure come into contact with each other and the socket assembly and the electric heating tube are powered on.

An infrared heating device provided in an embodiment of the present disclosure comprises the infrared heating mechanism described above.

BRIEF DESCRIPTION OF DRAWINGS

In order to more clearly illustrate the technical solutions of the embodiments of the present disclosure, brief description is made below on the drawings required to be used in the embodiments. It should be understood that the following drawings only illustrate some of the embodiments of the present disclosure and shall not be regarded as a limitation to the scope, and for a person of ordinary skills in the art, other related drawings may be obtained from these drawings without inventive effort.

Figure 1:
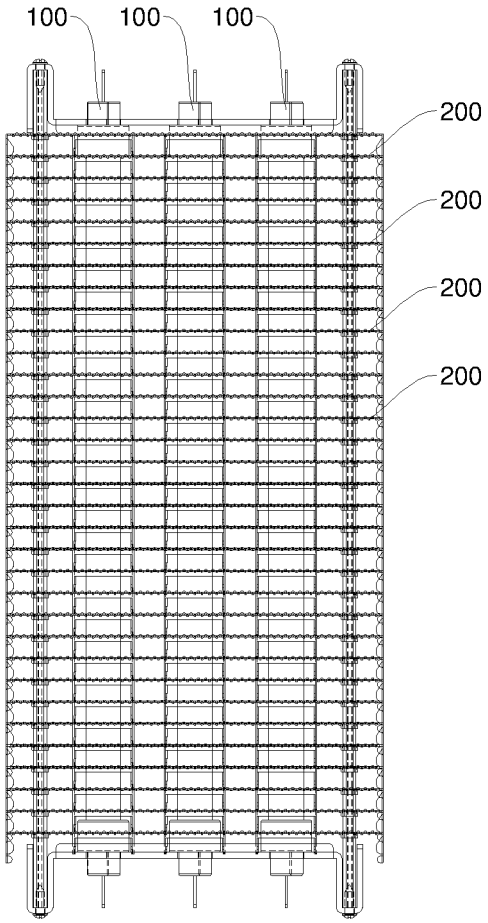
FIG. 1 is a schematic view of a first kind of infrared heating mechanism according to an embodiment of the present disclosure.

Reference signs: 100—infrared heating tube; 110—electric connector; 111—second electrically conductive structure; 200—reflection plate; 201—mounting hole; 202— connection portion; 210—insertion slot; 220—insertion plate; 230—stop wing; 240—reflection bump; 250—reflection groove; 300—second socket; 310—first electrically conductive structure; 320—insulating base; 330—spring; 340—jacket; 341—stop structure; 350—electrically conductive core; 400—baffle; 401—engagement hole; 410—notch; 500—first socket; 600—heat dissipation fan; 700—outer frame; 800—wire; and 900—shell.

DETAILED DESCRIPTION OF EMBODIMENTS

In order to make the objects, technical solutions and advantages of the embodiments of the present disclosure clearer, the technical solutions in the embodiments of the present disclosure will be described clearly and completely below with reference to the drawings of the embodiments of the present disclosure. Apparently, the embodiments described are some of the embodiments of the present disclosure, rather than all of the embodiments. The components of the embodiments of the present disclosure described and illustrated in the drawings herein can generally be arranged and designed in a variety of different configurations.

Thus, the following detailed descriptions of the embodiments of the present disclosure provided in the drawings are not intended to limit the scope of protection of the present disclosure, but is merely representative of the selected embodiments of the present disclosure. All the other embodiments that are obtained by a person of ordinary skills in the art without inventive effort on the basis of the embodiments of the present disclosure shall be covered by the scope of protection of the present disclosure.

It should be noted that like reference signs and letters denote like items in the drawings, and therefore, once a certain item is defined in one figure, it does not need to be further defined and explained in the following figures.

In the description of the present disclosure, it is to be noted that the orientation or position relation denoted by the terms such as "center", "upper", "lower", "left", "right", "vertical", "horizontal", "inner" and "outer" is based on the orientation or position relation indicated by the figures, or refers to the orientation or position where the product of the present disclosure is normally placed when in use, which only serves to facilitate describing the present disclosure and simplify the description, rather than indicating or suggesting that the device or element referred to must have a particular orientation, and is constructed and operated in a particular orientation, and therefore cannot be construed as a limitation on the present disclosure.

In addition, the terms such as "first", "second" and "third" are only used for differentiated description and cannot be construed as an indication or implication of relative importance.

In addition, the terms such as "horizontal", "vertical" and "pendulous" do not necessarily require that the components must be absolutely horizontal or pendulous, rather, they can be slightly inclined. For example, the term "horizontal" merely refers to a more horizontal direction relative to the direction indicated by the term "vertical", and does not necessarily require that the structure must be absolutely horizontal, rather, it can be slightly inclined.

In the description of the present disclosure, it should be further noted that unless otherwise explicitly specified and defined, the terms "arrange", "install", "link" and "connect" shall be understood in broad sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skills in the art could understand the specific meaning of the terms in the present disclosure according to specific situations.

It is to be noted that the features of the embodiments of the present disclosure can be combined with each other if there is no conflict.

Figure 2:
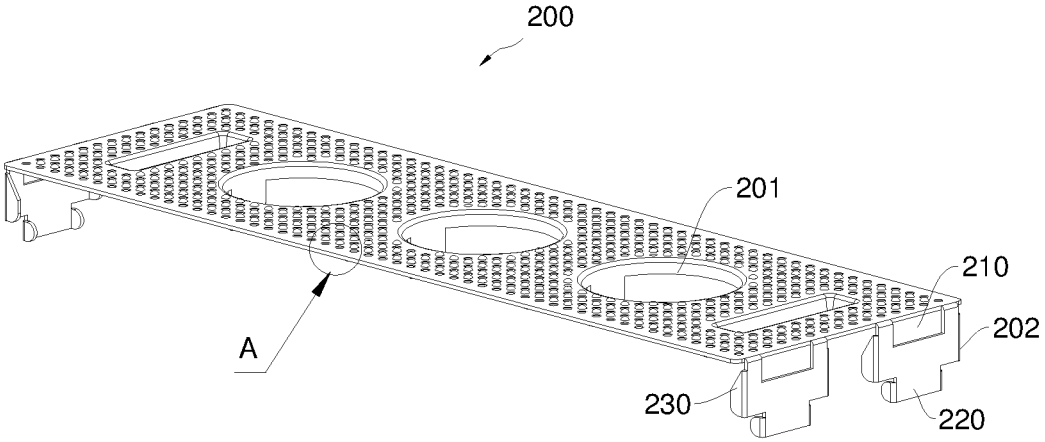
FIG. 2 is a schematic view of a first kind of reflection plate of the first kind of infrared heating mechanism according to an embodiment of the present disclosure.

Referring to FIG. 1 and FIG. 2, an infrared heating mechanism provided in an embodiment of the present disclosure comprises infrared heating tubes 100, a plurality of reflection plates 200 being disposed at intervals in a length direction of the infrared heating tubes 100, and mounting holes 201 corresponding to the infrared heating tubes 100, with the mounting holes provided on the reflection plates 200 so that the reflection plates 200 are sleeved on side walls of the infrared heating tubes 100. When energized by electricity, the infrared heating tubes 100 will emit infrared light to the outside, and the infrared light is radiated on the reflection plates 200. Multiple times of reflections of the infrared light may take place between any two adjacent reflection plates 200 among the plurality of reflection plates 200 that are disposed at intervals, and then the infrared light is diffused to the ambient. After the multiple times of reflections by the reflection plates 200, it is possible to uniformly transmit the energy emitted from the infrared heating tubes 100 to the outside, which avoids the accumulation of heat around the infrared heating tubes 100, thereby reducing the temperature around the infrared heating tubes 100 and increasing the service life of the infrared heating tubes 100. Moreover, the radiation of the infrared heating mechanism is no longer unidirectional, instead the radiation is omnidirectional, which is favorable for the overall temperature rise of a house and avoids bringing forth the burning sensation due to longtime local radiation.

The plane where the reflection plates 200 lie is perpendicular to the length direction of each of the infrared heating tubes 100, and the plurality of reflection plates 200 are uniformly arranged. The reflection plates 200 that are disposed at intervals reflect the infrared radiation uniformly to the ambient. Moreover, a corresponding connection structure is provided on an edge of each of the reflection plates 200.

Figure 4:
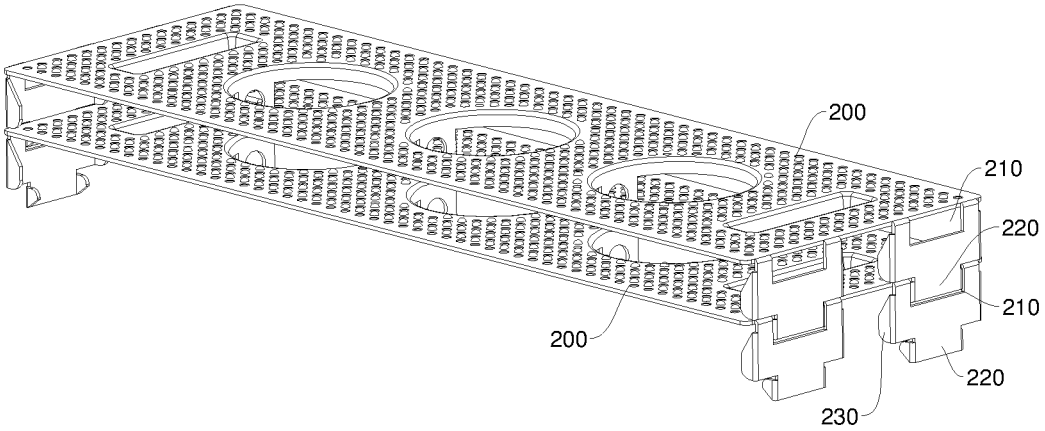
FIG. 4 is a schematic view after two reflection plates are stacked according to an embodiment of the present disclosure.

For example, referring to FIG. 2 and FIG. 4 in combination, connection portions 202 are provided on the edges of the two opposite ends of the reflection plate 200, with the connection portions bent towards the back surface of the reflection plate 200. The connection portions 202 are perpendicular to a reflection surface of the reflection plate 200, an insertion slot 210 is provided at the transition between each of the connection portion 202 and the reflection surface of each of the reflection plates 200, the insertion slots 210 are located on the connection portions 202 respectively, and an outer end of each of the connection portions 202 is provided with an insertion plate 220 corresponding to the respective insertion slot 210. When a plurality of reflection plates 200 are stacked, the insertion plates 220 on an upper reflection plate 200 can be inserted into the insertion slots 210 of a lower reflection plate 200. Stacking of the plurality of reflection plates 200 can be completed by means of insertion. As shown in FIG. 4, FIG. 4 shows a state in which two reflection plates 200 are stacked, and after the plurality of reflection plates 200 are sequentially stacked, the plurality of reflection plates 200 being stacked on top of one another as shown in FIG. 1 can be formed.

Referring to FIG. 2 and FIG. 4 in combination, on a single reflection plate 200, each connection portion 202 is provided with a stop wing 230 protruding relative to the respective connection portion 202, wherein the stop wings 230 are perpendicular to the connection portions 202 respectively, there are two stop wings 230 on each one connection portion 202, and the stop wings 230 are positioned between the insertion plates 220 and the insertion slots 210 respectively. When the insertion plate 220 is inserted into the respective insertion slot 210, the stop wings 230 can be pressed against the front surface of the lower reflection plate 200, thereby increasing the contact area between two adjacent reflection plates 200, and further improving the stacking stability of the reflection plates 200.

Figure 3:
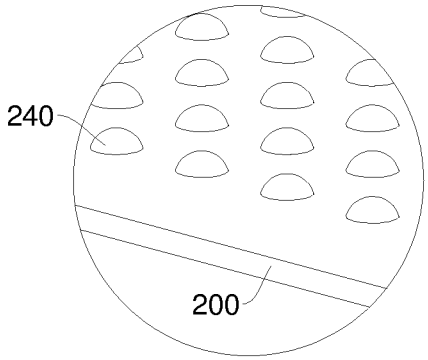
FIG. 3 is a partially enlarged view of position A in FIG. 2.

Specifically, referring to FIG. 3, the plate surface of the reflection plate 200 is provided thereon with reflection protrusions 240 which are configured to increase the reflection area of the reflection plate 200. The infrared light emitted by the infrared heating tubes 100 is irradiated on the reflection protrusions 240 on the reflection plate 200. On the one hand, the reflection protrusions 240 increase the reflection area of the reflection plate 200, enabling more infrared light to be received, and on the other hand, the reflection protrusions 240 can change the emission direction of the infrared rays and reflect the infrared light from between two adjacent reflection plates 200 to the outside so as to avoid the accumulation of the infrared light between the reflection plates 200.

Optionally, each of the reflection protrusions 240 is a semicircular protrusion, wherein the arc surface of the semicircular protrusion has a relatively large area for light receiving, which effectively improves the efficiency of light diffusion. When the infrared light is irradiated on the semicircular protrusion, a relatively large reflection angle can be formed, which enables the infrared light to emit farther. Evidently, the surface of each of the reflection protrusions 240 may also be a cylindrical surface, a tapered surface, an elliptical surface or a surface of other shapes.

Optionally, the infrared heating mechanism further comprises a heat dissipation fan 600 (shown in FIG. 11), and an air outlet of the heat dissipation fan 600 faces the infrared heating tubes 100. The infrared heating tubes 100 transmit energy to the outside in a light irradiation manner by emitting infrared light, and the heat dissipation fan 600 disposed on the side can exchange the cold air outside the infrared heating mechanism with the hot air inside the infrared heating mechanism, thereby heating the room more effectively.

Figure 5:
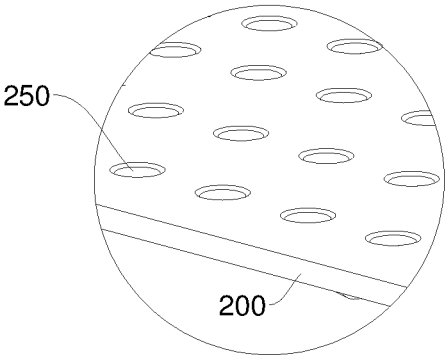
FIG. 5 is a partial schematic view of a second kind of reflection plate of the first kind of infrared heating mechanism according to an embodiment of the present disclosure.

Referring to FIG. 5, the plate surface of a second kind of each of the reflection plates 200 provided in this embodiment is provided thereon with reflection grooves 250 which are configured to increase the reflection area of the reflection plate 200. The infrared light emitted by the infrared heating tubes 100 is irradiated on the reflection grooves 250 on the reflection plate 200. On the one hand, the reflection grooves 250 increase the reflection area of the reflection plate 200, enabling more infrared light to be received, and on the other hand, the reflection grooves 250 can change the emission direction of the infrared light and reflect the infrared light from between two adjacent reflection plates 200 so as to prevent the accumulation of the infrared light between the reflection plates 200.

Optionally, each of the reflection grooves 250 is a semicircular groove and the arc surface of the semicircular groove has a relatively large area for light receiving, which effectively improves the efficiency of light diffusion. When the infrared light is irradiated on the semicircular grooves, a relatively large reflection angle can be generated, which enables the infrared light to emit farther. Evidently, the depressed surface of each of the reflection grooves 250 may also be a cylindrical surface, a tapered surface, an elliptical surface, an elliptical surface or a surface of other shapes.

Figure 6:
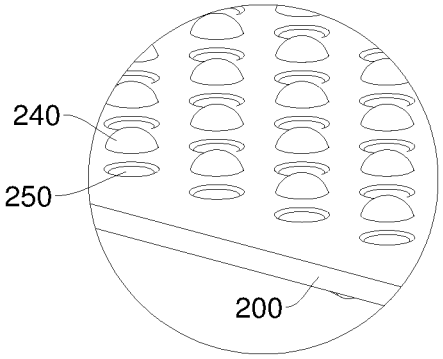
FIG. 6 is a partial schematic view of a third kind of reflection plate of the first kind of infrared heating mechanism according to an embodiment of the present disclosure.

Referring to FIG. 6, in view of the above, on a third kind of reflection plate 200 provided in this embodiment, the reflection protrusions 240 and the reflection grooves 250 can be uniformly distributed in a matrix shape, and the structure of concave-convex matrix is intended to increase the reflection area. Moreover, the infrared rays irradiated on the energy concentrating reflection plate 200 and the surface of the concave-convex matrix can be refracted in all directions, which has the advantage of bringing about a better equilibrium of the heat.

In FIG. 6, both the front surface and the back surface of the reflection plate 200 are provided thereon with the reflection protrusions 240 and the reflection grooves 250. In this way, both the upper surface and lower surface of a light exit channel formed between two adjacent reflection plates 200 have a concavo-convex matrix structure, so that the infrared light is radiated to the ambient after being reflected multiple times.

In order to facilitate the processing of the reflection plate 200, the reflection grooves 250 on the front surface of the reflection plate 200 are recessed towards the back surface of the reflection plate 200 from the front surface of the reflection plate 200 to form the reflection protrusions 240 on the back surface of the reflection plate 200; and the reflection grooves 250 on the back surface of the reflection plate 200 are recessed towards the front surface of the reflection plate 200 from the back surface of the reflection plate 200 to form the reflection protrusions 240 on the front surface of the reflection plate 200. The corresponding protrusions and grooves on the front and back surfaces can be processed in a matched manner by means of die casting, which can reduce the mass of the reflection plate 200.

In summary, the first kind of infrared heating mechanism provided in an embodiment of the present disclosure comprises infrared heating tubes 100, a plurality of reflection plates 200 being disposed at intervals in a length direction of the infrared heating tubes 100, and mounting holes 201 corresponding to the infrared heating tubes 100 being provided on the reflection plates 200 so that the reflection plates 200 are sleeved on side walls of the infrared heating tubes 100. A plurality of concave-convex matrixes are arranged on each of the reflection plates 200, the concave-convex matrixes serve to increase the reflection area, and the infrared rays irradiated on the reflection plates 200 for energy concentration and on the surfaces of the concave-convex matrixes can be refracted in all directions, which has the advantage of bringing about a better equilibrium of the heat. When energized by electricity, the infrared heating tubes 100 will emit infrared light to the outside, and the infrared light is radiated on the reflection plates 200. The infrared light will experience multiple times of reflections between any two adjacent reflection plates 200 among the plurality of reflection plates 200 that are disposed at intervals, and then the infrared light is diffused to the outside. After the multiple times of reflections by the reflection plates 200, it is possible to uniformly transmit the energy emitted from the infrared heating tubes 100 to the outside, which avoids the accumulation of heat around the infrared heating tubes 100, thereby reducing the temperature around the infrared heating tubes 100 and increasing the service life of the infrared heating tubes 100. Moreover, the radiation of the infrared heating mechanism is no longer unidirectional, instead, the radiation is omnidirectional, which is favorable for the overall temperature rise of the house and avoids bringing forth the burning sensation due to longtime local radiation. By providing a heat dissipation fan 600, it is possible to exchange the cold air outside the infrared heating mechanism with the hot air inside the infrared heating mechanism, thereby heating the room more effectively. The first kind of infrared heating mechanism provided by an embodiment of the present disclosure brings about the advantages of fast heating, rapid heat transfer, capability of effectively reducing heat loss, improving heat energy utilization rate and avoiding fire risk caused by local high temperature, and has no local burning sensation.

Figure 11:
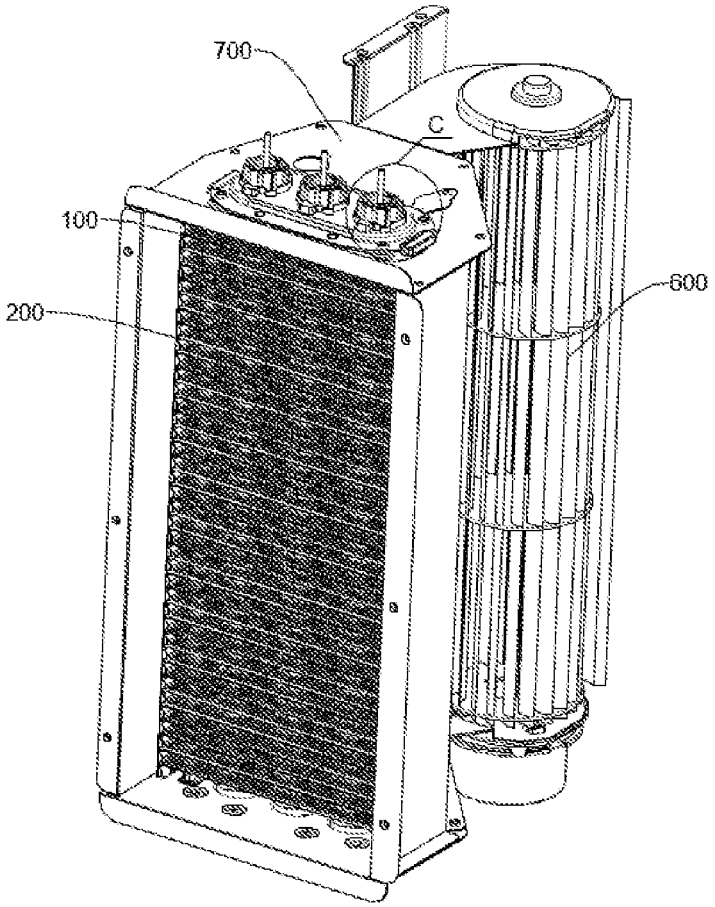
FIG. 11 is a schematic view of an infrared heating device according to an embodiment of the present disclosure.

Referring to FIG. 11, an infrared heating device provided in an embodiment of the present disclosure comprises an outer frame 700 and the above-described infrared heating mechanism. When energized by electricity, the infrared heating tubes 100 will emit infrared light to the outside, and the infrared light is radiated on the reflection plates 200. The infrared light will experience multiple times of reflections between any two adjacent reflection plates 200 among the plurality of reflection plates 200 that are disposed at intervals, and then the infrared light is diffused to the ambient. After the multiple times of reflections by the reflection plates 200, it is possible to uniformly transmit the energy emitted from the infrared heating tubes 100 to the outside, which avoids the accumulation of heat around the infrared heating tubes 100, thereby reducing the temperature around the infrared heating tubes 100 and increasing the service life of the infrared heating tubes 100. Moreover, the radiation of the infrared heating mechanism is no longer unidirectional, instead, the radiation is omnidirectional, which is favorable for the overall temperature rise of the house and avoids bringing forth the burning sensation due to longtime local radiation. The infrared heating mechanism is positioned inside the outer frame 700, and the outer frame 700 is configured to prevent a user from touching the infrared heating mechanism by accident.

Referring to FIG. 7 to FIG. 10, the second kind of infrared heating mechanism provided in an embodiment of the present disclosure comprises socket assemblies and electric heating tubes independent of each other, wherein an electric connector 110 is provided on each of the electric heating tubes, a first electrically conductive structure 310 and a second electrically conductive structure 111 are provided on each of the socket assemblies and each of the electric connectors 110, respectively, so that after the electric connector 110 is inserted into the respective socket assembly, the first electrically conductive structures 310 and the second electrically conductive structures 111 come into contact with each other and the socket assemblies and the electric heating tubes are powered on.

It is to be noted that in this embodiment, each of the electric heating tubes may be construed as the infrared heating tube 100, this mechanism changes the conventional structure that the electric heating tubes are integrated with the electrically conductive structures, wherein the electric heating tubes and the socket assemblies are designed to be a split-type structure, and electrical connections therebetween are realized by means of plugging-in. When one of the electric heating tubes is in malfunction, the electric heating tube can be directly disassembled and replaced, which not only reduces the maintenance cost, but also improves the maintenance efficiency.

Each of the socket assemblies comprises a wire 800 connected with an external power source, and by means of the socket assemblies, it is possible to supply power to the electric heating tubes so that the electric heating tubes converts electric energy into heat energy.

Specifically, each of the electric heating tubes comprises two electric connectors 110 located at the two ends thereof, respectively, and the second electrically conductive structure 111 is located on each of the electric connectors 110; each of the socket assemblies comprises a first socket 500 and a second socket 300, wherein the first socket 500 and the second socket 300 are connected at the two ends of each of the electric heating tube, respectively, by means of plugging-in.

The infrared heating mechanism further comprises shells 900, wherein each of the first sockets 500 is fixed on the respective shell 900, and each of the second sockets 300 is movably connected with the respective shell 900. It is feasible to implement electrical connection of one of the electric heating tubes by removing the second socket 300 first, then inserting one end of the electric heating tube into the first socket 500, and finally inserting the second socket 300 into the other end of the electric heating tube.

Each of the shells 900 comprises a baffle 400, wherein a gap is formed between the baffle 400 and the electric connector 110 adjacent thereto. Each of the second sockets 300 comprises an electrically conductive core 350 and a jacket 340, wherein the jacket 340 is slidably sleeved on the outer side of the electrically conductive core 350. a limiting groove and a limiting protrusion are provided between the jacket 340 and the electrically conductive core 350, wherein the limiting protrusion is located in the limiting groove, so that the limiting protrusion can slide in the length direction of the limiting groove, and the limiting protrusion is configured to prevent the jacket 340 from being separated from the electrically conductive core 350. The outer wall of each of the jackets 340 is provided with a stop structure 341, each of the baffles 400 is provided thereon with an engagement hole 401 corresponding to the respective jacket 340, the engagement hole 401 is aligned with the respective electric connector 110 so that the stop structure 341 is rotationally engaged in the gap after passing through the engagement hole 401. When in use, one end of each of the electric heating tubes is inserted into the respective first socket 500, then the respective second socket 300 is inserted into the engagement hole 401, after each of the stop structures 341 passes through the respective engagement hole 401, each of the second sockets 300 is rotated to engage the respective stop structure 341 on the surface of each of the baffles 400 facing the respective electric connector 110, thereby completing the fixing of the second sockets 300.

The size of each of the engagement holes 401 needs to be larger than the size of the electric heating tubes, facilitating withdrawing of the electric heating tube from the engagement hole 401.

Figure 10:
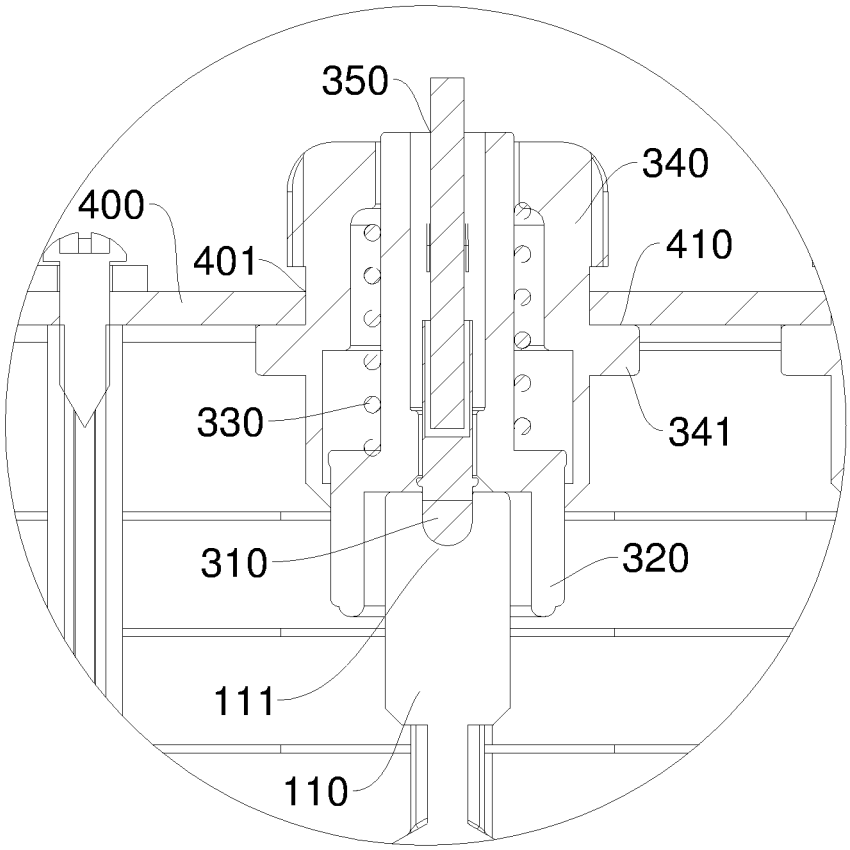
FIG. 10 is a partially enlarged view of position B in FIG. 9.
Figure 12:
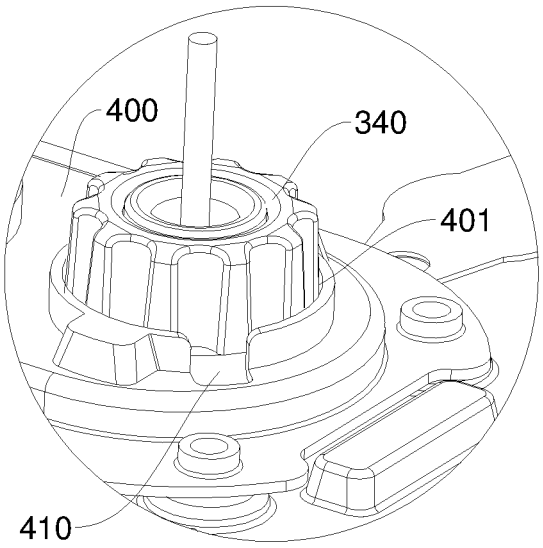
FIG. 12 is a partially enlarged view of position C in FIG. 11.

With reference to FIG. 10 and FIG. 12 in combination, each of the stop structures 341 comprises two protrusions protruding outwards in the circumferential direction of the respective jacket 340, with the two protrusions protruding outwards in opposite directions, and correspondingly, each of the engagement holes 401 comprises notches 410 corresponding to the two protrusions, wherein the protrusions are aligned with the notches 410 respectively, each of the second sockets 300 can be inserted into the respective engagement hole 401, the second socket 300 are rotated to make the protrusions offset from the notches 410, and each of the second sockets 300 is engaged between the respective baffle 400 and the respective electric heating tube.

Similarly, it is also feasible to arrange the first sockets 500 to have the same structure as the second sockets 300, so that each of the first sockets 500 is also movably connected with the respective shell 900.

Each of the electrically conductive cores 350 comprises an insulating base 320, and each of the first electrically conductive structures 310 is fixed at the bottom of the respective insulating base 320 such that the first electrically conductive structure 310 comes into contact with the second electrically conductive structure 111 after the electric connector 110 is inserted into the insulating base 320. The first electrically conductive structures 310 and the second electrically conductive structures 111 come into contact with each other in the respective insulating bases 320, which reduces the probability of electric leakage and improves the safety performance.

The insulating bases 320 may be made of insulating ceramic.

A spring 330 is disposed between each of the electrically conductive cores 350 and each of the jackets 340. Each of the spring 330 is a compression spring, when each of the second sockets 300 is inserted into the respective engagement hole 401, the spring 330 is compressed, after the respective stop structure 341 passes through the engagement hole 401, the second socket 300 is rotated to cause the stop structure 341 to abut against the bottom surface of the respective baffle 400, and the spring 330 drives the respective electrically conductive core 350 to move towards the respective electric connector 110, so that the first electrically conductive structures 310 come into better contact with the second electrically conductive structures 111.

Figure 7:
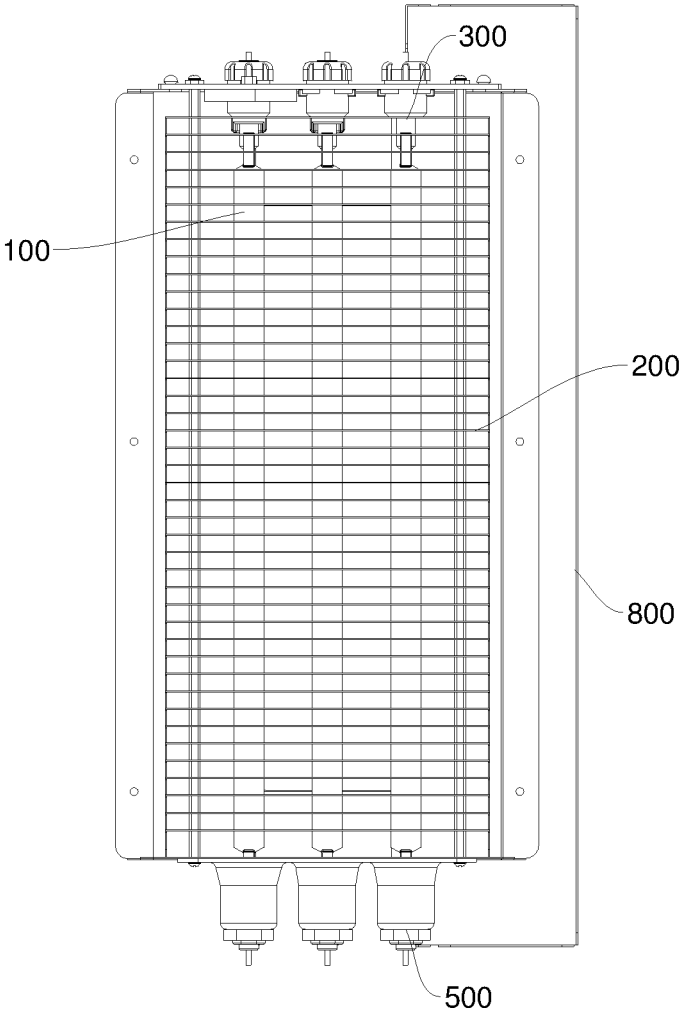
FIG. 7 is a schematic view of a second kind of infrared heating mechanism according to an embodiment of the present disclosure, from one view angle.

Referring to FIG. 7, in combination with FIG. 2, a plurality of reflection plates 200 are disposed at intervals in a length direction of the electric heating tubes, and mounting holes 201 corresponding to the electric heating tubes are provided on each of the reflection plates 200 so that the reflection plates 200 are sleeved on side walls of the electric heating tubes. When energized by electricity, the electric heating tubes will emit infrared light to the outside, and the infrared light is radiated on the reflection plates 200. The infrared light will experience multiple times of reflections between any two adjacent reflection plates 200 among the plurality of reflection plates 200 that are disposed at intervals, and then the infrared light is diffused to the ambient. After the multiple times of reflections by the reflection plates 200, it is possible to uniformly transmit the energy emitted from the electric heating tubes to the outside, which avoids the accumulation of heat around the electric heating tubes, thereby reducing the temperature around the electric heating tubes and increasing the service life of the electric heating tubes. Moreover, the radiation of the infrared heating mechanism is no longer unidirectional, but in all direction, which is favorable for the overall temperature rise of the house and avoids bringing forth the burning sensation due to longtime local radiation.

The plane where the reflection plates 200 lie is perpendicular to the length direction of the electric heating tubes and the plurality of reflection plates 200 are uniformly arranged. The reflection plates 200 that are disposed at intervals reflect the infrared radiation uniformly to the ambient. Moreover, a corresponding connection structure is provided on an edge of each of the reflection plates 200.

Specifically, in combination with FIG. 3, the plate surface of the reflection plate 200 is provided thereon with reflection protrusions 240 which are configured to increase the reflection area of the reflection plate 200. The infrared light emitted by the electric heating tubes is irradiated on the reflection protrusions 240 on the reflection plate 200. On the one hand, the reflection protrusions 240 increase the reflection area of the reflection plate 200, enabling more infrared light to be received, and on the other hand, the reflection protrusions 240 can change the emission direction of the infrared light and reflect the infrared light from between two adjacent reflection plates 200 so as to prevent the accumulation of the infrared light from between the reflection plates 200.

Optionally, each of the reflection protrusions 240 is a semicircular protrusion and the arc surface of each of the semicircular protrusions has a relatively large area for light receiving, which effectively improves the efficiency of light diffusion. When the infrared light is irradiated on the semicircular protrusions, a relatively large reflection angle can be generated, which enables the infrared light to emit farther. Evidently, the surface of each of the reflection protrusions 240 may also be a cylindrical surface, a tapered surface, an elliptical surface or a surface of other shapes.

Optionally, the infrared heating mechanism further comprises a heat dissipation fan 600 (shown in FIG. 11), and an air outlet of the heat dissipation fan 600 faces the electric heating tube. The electric heating tube transmits energy to the outside in a light irradiation manner by emitting infrared light, and the heat dissipation fan 600 disposed on the side can exchange the cold air outside the infrared heating mechanism with the hot air inside the infrared heating mechanism, thereby heating the room more effectively.

Referring to FIG. 5, the plate surface of the reflection plate 200 in FIG. 5 is provided thereon with reflection grooves 250 which are configured to increase the reflection area of the reflection plate 200. The infrared light emitted by the electric heating tube is irradiated on the reflection grooves 250 on the reflection plate 200. On the one hand, the reflection grooves 250 increase the reflection area of the reflection plate 200, enabling more infrared light to be received, and on the other hand, the reflection grooves 250 can change the emission direction of the infrared light and reflect the infrared light from between two adjacent reflection plates 200 so as to prevent the accumulation of the infrared light between the reflection plates 200.

Optionally, each of the reflection grooves 250 is a semicircular groove and the arc surface of the semicircular groove has a relatively large area for light receiving, which effectively improves the efficiency of light diffusion. When the infrared light is irradiated on the semicircular grooves, a relatively large reflection angle can be generated, which enables the infrared light to emit farther. Evidently, the depressed surface of each of the reflection grooves 250 may also be a cylindrical surface, a tapered surface, an elliptical surface or a surface of other shapes.

Referring to FIG. 6, optionally, on the reflection plate 200, the reflection protrusions 240 and the reflection grooves 250 can be uniformly distributed in a matrix shape, and the structure of concave-convex matrix is intended to increase the reflection area. Moreover, the infrared rays irradiated on the energy concentrating reflection plate 200 and the surface of the concave-convex matrix can be refracted in all directions, which has the advantage of bringing about a better equilibrium of the heat.

In FIG. 6, both the front surface and the back surface of the reflection plate 200 are provided thereon with the reflection protrusions 240 and the reflection grooves 250. In this way, both the upper surface and the lower surface of a light exit channel formed between two adjacent reflection plates 200 have a concavo-convex matrix structure, so that the infrared light is radiated to the ambient after being reflected multiple times.

In order to facilitate the processing of the reflection plate 200, the reflection grooves 250 on the front surface of the reflection plate 200 are recessed towards the back surface of the reflection plate 200 from the front surface of the reflection plate 200 to form the reflection protrusions 240 on the back surface of the reflection plate 200; and the reflection grooves 250 on the back surface of the reflection plate 200 are recessed towards the front surface of the reflection plate 200 from the back surface of the reflection plate 200 to form the reflection protrusions 240 on the front surface of the reflection plate 200. The corresponding protrusions and grooves on the front and back surfaces can be processed in a matched manner by means of die casting, which can reduce the mass of the reflection plate 200.

Referring to FIG. 11, an infrared heating device provided in an embodiment of the present disclosure comprises an outer frame 700 and the above-described infrared heating mechanism. The infrared heating mechanism is positioned inside the outer frame 700, and the outer frame 700 is configured to prevent a user from accidentally touching the infrared heating mechanism. When energized by electricity, the electric heating tubes will emit infrared light to the outside, and the infrared light is radiated on the reflection plates 200. The infrared light will experience multiple times of reflections between any two adjacent reflection plates 200 among the plurality of reflection plates 200 that are disposed at intervals, and then the infrared light is diffused to the ambient. After the multiple times of reflections by the reflection plates 200, it is possible to uniformly transmit the energy emitted from the electric heating tubes to the outside, which avoids the accumulation of heat around the electric heating tubes, thereby reducing the temperature around the electric heating tubes and increasing the service life of the electric heating tubes. Moreover, the radiation of the infrared heating mechanism is no longer unidirectional, instead, the radiation is omnidirectional, which is favorable for the overall temperature rise of the house and avoids bringing forth the burning sensation due to longtime local radiation. The infrared heating mechanism is positioned inside the outer frame 700, and the outer frame 700 is configured to prevent a user from accidentally touching the infrared heating mechanism.

In some embodiments:

Referring to FIG. 1, the infrared heating mechanism shown in FIG. 1 comprises infrared heating tubes 100 and a plurality of reflection plates 200 disposed at intervals in a length direction of the infrared heating tubes 100. The reflection plates 200 are connected with the infrared heating tubes 100, and the infrared heating tubes 100 pass through the reflection plates 200. In FIG. 1, three infrared heating tubes 100 are shown, which are distributed horizontally, a plurality of reflection plates 200 are shown, the plurality of reflection plates 200 are distributed vertically, and two adjacent reflection plates 200 form a light exit channel through which light emitted from the infrared heating tubes 100 is radiated to the ambient.

Referring to FIG. 2, the reflection plate 200 shown in FIG. 2 is provided with mounting holes 201 corresponding to the infrared heating tubes 100, so that the reflection plate 200 is sleeved on the side wall of the infrared heating tubes 100, and correspondingly, the reflection plate 200 is provided thereon with three mounting holes 201 for mounting three infrared heating tubes 100. Connection portions 202 are provided on the edges of the two opposite ends of the reflection plate 200, with the connection portions bent towards the back surface of the reflection plate 200. The connection portions 202 are perpendicular to a reflection surface of the reflection plate 200, an insertion slot 210 is provided at the transition between each of the connection portions 202 and the reflection surface of each of the reflection plates 200, the insertion slots 210 are located on the connections portion 202 respectively, and an outer end of each of the connection portions 202 are provided with an insertion plate 220 corresponding to the respective insertion slot 210. When a plurality of reflection plates 200 are stacked, the insertion plates 220 on an upper reflection plate 200 can be inserted into the insertion slots 210 of a lower reflection plate 200. Each connection portion 202 is provided with a stop wing 230 protruding relative to the respective connection portion 202, the stop wings 230 are perpendicular to the connection portions 202 respectively, there are two stops wing 230 on each one connection portion 202, and the stop wings 230 are positioned between the insertion plates 220 and the insertion slots 210 respectively. When the insertion plate 220 is inserted into the respective insertion slot 210, the stop wings 230 can be pressed against the front surface of the lower reflection plate 200. Specifically, the two ends of the reflection plate 200 are provided with two connection portions 202, respectively, and there is a gap between the two connection portions 202 at the same end of the reflection plate 200.

Referring to FIG. 3, the reflection plate 200 shown in FIG. 3 is provided with reflection protrusions 240 configured to increase the reflection area of the reflection plate 200.

Referring to FIG. 4, FIG. 4 shows two reflection plates 200, each reflection plate 200 has a structure as shown in FIG. 2. The stacking of multiple reflection plates 200 is realized by the cooperation between the respective insertion slots 210 and the insertion plates 220 of two reflection plates 200 as well as by position limiting through the stop wings 230.

Referring to FIG. 5, the reflection plate 200 shown in FIG. 5 is provided thereon with reflection grooves 250 configured to increase the reflection area of the reflection plate 200.

Referring to FIG. 6, the reflection plate 200 shown in FIG. 6 is provided thereon with reflection protrusions 240 and reflection grooves 250 that are configured to increase the reflection area of the reflection plate 200. Specifically, reflection protrusions 240 and reflection grooves 250 are distributed on both the front surface and the back surface of the reflection plate 200. The reflection grooves 250 on the front surface of the reflection plate 200 are recessed towards the back surface of the reflection plate 200 from the front surface of the reflection plate 200 to form the reflection protrusions 240 on the back surface of the reflection plate 200; and the reflection grooves 250 on the back surface of the reflection plate 200 are recessed towards the front surface of the reflection plate 200 from the back surface of the reflection plate 200 to form the reflection protrusions 240 on the front surface of the reflection plate 200.

Referring to FIG. 7, the infrared heating mechanism shown in FIG. 7 comprises electric heating tubes and a plurality of reflection plates 200 disposed at intervals in a length direction of the electric heating tubes. The reflection plates 200 are connected with the electric heating tubes, and the electric heating tubes pass through the reflection plates 200. In FIG. 1, three electric heating tubes are shown, which are distributed horizontally, a plurality of reflection plates 200 are shown, the plurality of reflection plates 200 are distributed vertically, and two adjacent reflection plates 200 form a light exit channel through which light emitted from the electric heating tubes is radiated to the ambient. The electric heating tubes are the infrared heating tubes 100 shown in FIG. 7. Moreover, the two ends of each of the infrared heating tubes 100 are adapted to be plugged in the first socket 500 and the second socket 300, respectively, so as to be powered, and the wire 800 is connected to the first socket 500 and the second socket 300 and connected to an external power source, so as to be powered.

Figure 8:
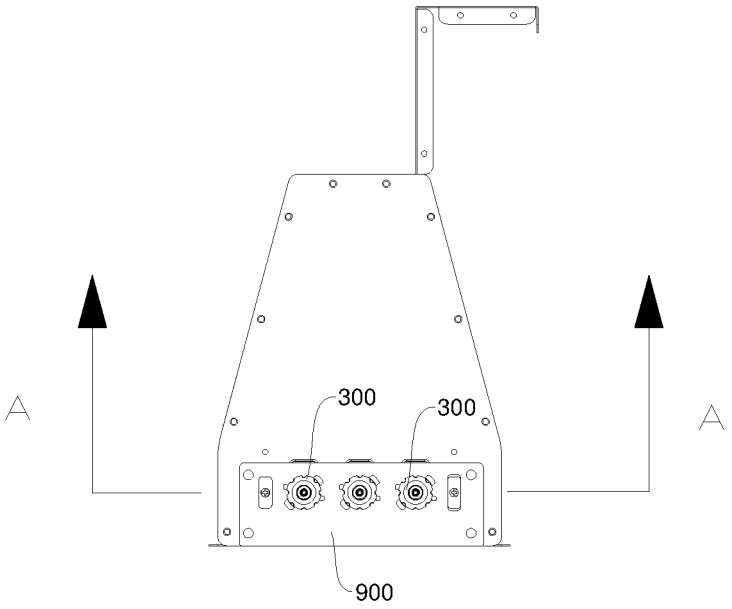
FIG. 8 is a schematic view of the second kind of infrared heating mechanism according to an embodiment of the present disclosure, from another view angle.

Referring to FIG. 8, in FIG. 8, there are three second sockets 300, the three second sockets are in one-to-one correspondence to the three infrared heating tubes 100. The infrared heating mechanism further comprises a shell 900, the second sockets 300 are movably connected with the shell 900, and correspondingly, the first socket 500 is fixedly connected with the shell 900. The shell 900 may be one structure similar to an enclosure for enclosing and protecting the infrared heating tubes 100, or may be two structures and both ends of each of the infrared heating tubes 100 are provided with the shell 900.

Figure 9:
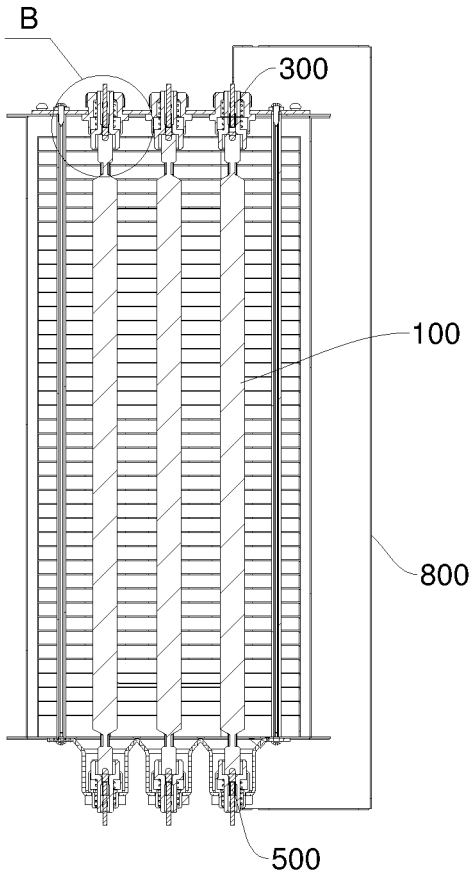
FIG. 9 is a sectional view in the direction of A-A in FIG. 8.

Referring to FIG. 9, the structure in FIG. 9 is the same as that in FIG. 7.

Referring to FIG. 10, an end of the infrared heating tube 100 is connected with the electric connector 110, the second socket 300 is provided with the first electrically conductive structure 310, and the electric connector 110 is provided with the second electrically conductive structure 111. After the electric connector 110 is inserted into the second socket 300, the first electrically conductive structure 310 and the second electrically conductive structure 111 come into contact with each other and the second socket 300 and the infrared heating tube 100 are powered on. The shell 900 comprises a baffle 400, wherein a gap is formed between the baffle 400 and the electric connector 110 adjacent thereto. The second socket 300 comprises an electrically conductive core 350 and a jacket 340, wherein the jacket 340 is slidably sleeved on the outer side of the electrically conductive core 350. Between the jacket 340 and the electrically conductive core 350 are a limiting groove and a limiting protrusion, the limiting protrusion is located in the limiting groove, so that the limiting protrusion can slide in the length direction of the limiting groove, and the limiting protrusion is configured to prevent the jacket 340 from being separated from the electrically conductive core 350. The outer wall of the jacket 340 is provided with a stop structure 341, the baffle 400 is provided thereon with an engagement hole 401 corresponding to the jacket 340, the engagement hole 401 is aligned with the electric connector 110 so that the stop structure 341 is rotationally engaged in the gap after passing through the engagement hole 401. The stop structure 341 comprises two protrusions protruding outwards in the circumferential direction of the jacket 340, with the two protrusions protruding in opposite directions. Referring to FIG. 12, the engagement hole 401 comprises notches 410 corresponding to the two protrusions, the two protrusions can extend into the engagement hole 401 along the two notches 410, and then are rotated by a certain angle, then the jacket 340 can prevent slipping out of the components. The electrically conductive core 350 comprises an insulating base 320, and the first electrically conductive structure 310 is fixed at the bottom of the insulating base 320 such that the first electrically conductive structure 310 comes into contact with the second electrically conductive structure 111 after the electric connector 110 is inserted into the insulating base 320. A spring 330 is disposed between the electrically conductive core 350 and the jacket 340. The spring 330 drives the electrically conductive core 350 to move towards the electric connector 110, so that the first electrically conductive structure 310 comes into better contact with the second electrically conductive structure 111.

Referring to FIG. 11, the infrared heating device shown in FIG. 11 comprises an outer frame 700 and the above-described infrared heating mechanism. The infrared heating mechanism is positioned inside the outer frame 700, and the outer frame 700 is configured to prevent a user from accidentally touching the infrared heating mechanism. Moreover, the heat dissipation fan 600 is also mounted on the outer frame 700 to blow air to the back of the infrared heating mechanism so that cold air enters the infrared heating mechanism from the back thereof, and hot air heated by the infrared heating tubes 100 is blown out from the front of the infrared heating mechanism.

Referring to FIG. 12, the protrusions on the jacket 340 shown in FIG. 12 extend into the engagement hole 401 through the notches 410 of the engagement hole 401. By rotating the jacket 340, it is possible to fix the jacket 340 in the engagement hole 401.

Finally, it should be noted that the above embodiments are only specific implementation modes of the present disclosure and are used to illustrate the technical solutions of the present disclosure, rather than limit the same, and the scope of protection of the present disclosure is not limited thereto; although the present disclosure has been described in detail with reference to the foregoing embodiments, it should be understood by a person of ordinary skills in the art that within the technical scope in the present discourse, a person skilled in the art could still modify the technical solutions described in the embodiments, readily conceive variations thereof, or make equivalent substitution to some of the technical features therein; and the modifications, variations or substitutions would not cause the substance of the corresponding technical solutions to depart from the spirit and scope of the technical solutions of the embodiments of the present disclosure, thus shall all be covered by the scope of protection of the present disclosure. Therefore, the scope of protection of the present disclosure shall be determined by the scope of protection of the appended claims.

INDUSTRIAL APPLICABILITY

In summary, the present disclosure provides an infrared heating mechanism and device, having a simple structure and capable of improving heat utilization rate while effectively improving the service life of the infrared heating tubes.

The invention claimed is:

1. An infrared heating mechanism, comprising infrared heating tubes, wherein a plurality of reflection plates are disposed at intervals in a length direction of the infrared heating tubes, the plurality of reflection plates are each provided with mounting holes corresponding to the infrared heating tubes, so that the reflection plates are sleeved on side walls of the infrared heating tubes, and the plurality of reflection plates are configured so that multiple times of reflections of infrared light take place between any two adjacent reflection plates among the plurality of reflection plates, wherein a plane where the reflection plates lie is perpendicular to a length direction of the infrared heating tubes, and the plurality of reflection plates are uniformly arranged, and connection portions bent towards the back surface of each of the reflection plates are provided at edges of two opposite ends of each of the reflection plates, the connection portions are perpendicular to a reflection surface of each of the reflection plates, an insertion slot is provided at transition between each of the connection portions and the reflection surface of each of the reflection plates, the insertion slots are located on the connection portions respectively, an outer end of each of the connection portions is provided with an insertion plate corresponding to the respective insertion slot, and when a plurality of reflection plates are stacked, the insertion plates on an upper reflection plate can be inserted into the respective insertion slots of a lower reflection plate.

2. The infrared heating mechanism according to claim 1, wherein a reflection protrusion is provided on a plate surface of each of the reflection plates, and the reflection protrusion is configured to increase a reflection area of each of the reflection plates; and/or a reflection groove is provided on a plate surface of each of the reflection plates, and the reflection groove is configured to increase the reflection area of each of the reflection plates.

3. The infrared heating mechanism according to claim 2, wherein the reflection protrusion is a semicircular protrusion; and/or the reflection groove is a semicircular groove.

4. The infrared heating mechanism according to claim 1, wherein both front surface and back surface of each of the reflection plates are provided with a reflection protrusion and a reflection groove.

5. The infrared heating mechanism according to claim 4, wherein the reflection groove on the front surface of the reflection plate is recessed towards the back surface of the reflection plate from the front surface of the reflection plate, to form the reflection protrusion on the back surface of the reflection plate; and the reflection groove on the back surface of the reflection plate is recessed towards the front surface of the reflection plate from the back surface of the reflection plate, to form the reflection protrusion on the front surface of the reflection plate.

6. The infrared heating mechanism according to claim 1, wherein the infrared heating mechanism further comprises a heat dissipation fan and an air outlet of the heat dissipation fan faces the infrared heating tubes.

7. The infrared heating mechanism according to claim 1, wherein each connection portion is provided with a stop wing protruding relative to the respective connection portion, the stop wings are perpendicular to the connection portions respectively, number of the stop wings located on each connection portion is two, with the stop wings positioned between the insertion plate and the insertion slot of the each connection portion, and when the insertion plates on the upper reflection plate are inserted into the insertion slots of the lower reflection plate, the stop wings can be pressed against the front surface of the lower reflection plate.

8. An infrared heating mechanism, comprising socket assemblies and electric heating tubes independent of each other, wherein an electric connector is provided on each of the electric heating tubes, a first electrically conductive structure and a second electrically conductive structure are provided on each of the socket assemblies and each of the electric connectors respectively, so that after each of the electric connectors is inserted into the respective socket assembly, the first electrically conductive structures and the second electrically conductive structures come into contact with each other and the socket assemblies and the electric heating tubes are powered on wherein each of the electric heating tubes is an infrared heating tube, wherein each of the electric heating tubes comprises two electric connectors located at the two ends of the electric heating tube respectively, and the second electrically conductive structure is located on each of the electric connectors;

each of the socket assemblies comprises a first socket and a second socket, and the first socket and the second socket are connected with the respective two electric connectors, respectively, by means of plugging-in;

the infrared heating mechanism further comprises shells, each of the first sockets is fixed on the respective shell, and each of the second sockets is movably connected with the respective shell, each of the shell comprises a baffle, and a gap is formed between the baffle and the electric connector adjacent to the baffle;

each of the second sockets comprises an electrically conductive core and a jacket, the jacket is slidably sleeved on an outer side of the electrically conductive core, a limiting groove and a limiting protrusion are provided between the jacket and the electrically conductive core, the limiting protrusion is located in the limiting groove, so that the limiting protrustion can slide in a length direction of the limiting groove, and the limiting protrusion is configured to prevent the jacket from being separated from the electrically conductive core; and an outer wall of the jacket is provided thereon with a stop structure, the baffle is provided with an egagement hole corresponding to the jacket, and the engagement hole is aligned with the electric connector so that the stop structure is rotationally engaged in the gap after passing through the engagement hole.

9. The infrared heating mechanism according to claim 8, wherein the stop structure comprises two protrusions protruding outwards in a circumferential direction of the jacket, with the two protrusions protruding in opposite directions.

10. The infrared heating mechanism according to claim 8, wherein the electrically conductive core comprises an insulating base, and each of the first electrically conductive structures is fixed at a bottom of the respective insulating base such that the first electrically conductive structure comes into contact with the respective second electrically conductive structure after the respective electric connector is inserted into the insulating base.

11. The infrared heating mechanism according to claim 8, wherein a spring is disposed between each of the electrically conductive cores and each of the jackets.

12. The infrared heating mechanism according to claim 8, wherein a plurality of reflection plates are disposed at intervals in a length direction of the electric heating tubes, and the plurality of reflection plates are each provided with a mounting hole corresponding to the electric heating tube so that the reflection plates are sleeved on side wall of the electric heating tube;

a plane where the reflection plates lie is perpendicular to the length direction of the electric heating tubes, and the plurality of reflection plates are uniformly arranged; and a reflection protrusion and/or a reflection groove are/is provided on a plate surface of each of the reflection plates, and the reflection protrusion and the reflection groove are configured to increase a reflection area of each of the reflection plates.

13. An infrared heating device, comprising the infrared heating mechanism according to claim 1.

14. The infrared heating device according to claim 13, wherein a plane where the reflection plates lie is perpendicular to a length direction of the infrared heating tubes, and the plurality of reflection plates are uniformly arranged.

15. The infrared heating device according to claim 13, wherein a reflection protrusion is provided on a plate surface of each of the reflection plates, and the reflection protrusion is configured to increase a reflection area of each of the reflection plates; and/or a reflection groove is provided on a plate surface of each of the reflection plates, and the reflection groove is configured to increase the reflection area of each of the reflection plates.

* * * * *